United States Patent [19]

Hall et al.

[11] Patent Number: 4,934,113

[45] Date of Patent: Jun. 19, 1990

[54] PORTABLE STAGE WITH TELESCOPIC STAGE SECTIONS

[76] Inventors: Robert Hall, 10 Austin Crescent, Toronto, Ontario M5R 3E3; P. Reginald Taylor, 15 Scadding Avenue, Apt. 916, Toronto, Ontario, M5A 4E9, both of Canada

[21] Appl. No.: 250,103

[22] Filed: Sep. 28, 1988

[51] Int. Cl.[5] ..... E04H 3/26

[52] U.S. Cl. ..... 52/7; 52/143; 182/223

[58] Field of Search ..... 108/92, 93; 280/79.1, 280/79.1 A; 52/143, 6–10; 182/131, 132, 223

[56] References Cited

U.S. PATENT DOCUMENTS

| | | | |
|---|---|---|---|
| 1,310,028 | 7/1919 | Mahan et al. | 280/79.1 |
| 3,335,533 | 8/1967 | Bahr | 52/143 |
| 3,400,502 | 9/1968 | Scaggs et al. | 182/223 |
| 3,747,708 | 7/1973 | Wenger et al. | 52/9 |

*Primary Examiner*—James L. Ridgill, Jr.

[57] ABSTRACT

The present invention provides a portable stage riser comprising a plurality of individual stage sections at different heights. The stage sections are telescopically interconnected with one another by a track system for sliding from a collapsed to an extended position. The stage when collapsed is tipable on to its back surface which is reinforced with a dolly receiving guide for upright storage of the stage.

5 Claims, 6 Drawing Sheets

PORTABLE STAGE WITH TELESCOPIC STAGE SECTIONS

FIELD OF THE INVENTION

The present invention relates to a portable stage formed from telescopic stage risers.

BACKGROUND OF THE INVENTI0N

Stages having multi-leveled tiers are very useful in entertainment areas. These multi-tiered stages provide both acoustical as well as visual improvements over flat stages when used by musical bands and in particular those employing a host of different and typically large musical instruments. Unlike flat stage set ups where everything is blocked, a tiered set up allows the carrying of both voiced and instrumental sounds from the back to the front of the stage and out to the audience and further allows the audience to actually see the performers at the back of the stage.

By making the stage of a tiered construction, there is the further benefit that the stage can actually be telescopically collapsed to minimize the space that it occupies when not in use. This feature has been recognized in the past as illustrated for example in U.S. Pat. No. 4,467,569, issued Aug. 28, 1984 to Blanchard et al and U.S. Pat. No. 3,400,502, issued Sept. 10, 1968 to Scaggs et al.

The structures of each of the above patents still however take up more space than necessary even when in the collapsed condition as for example shown in FIG. 3 of the former patent and FIG. 1 of the latter patent.

SUMMARY OF THE PRESENT INVENTION

The present invention provides a portable stage comprising a plurality of individual stage sections at different heights and telescopically interconnected by a track system for sliding from a collapsed to an extended position. The stage has a back surface at right angles to the direction in which the sections slide. This back surface is provided with reinforcing means onto which the stage is tipable when collapsed for an upright minimum space requiring storage of the stage.

According to an aspect of the invention, the reinforcing means at the back surface of the stage includes a guide for receiving a roller for rolling the stage when in the upright storage position to different desired storage or use areas.

BRIEF DESCRIPTION OF THE DRAWINGS

The above as well as other features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
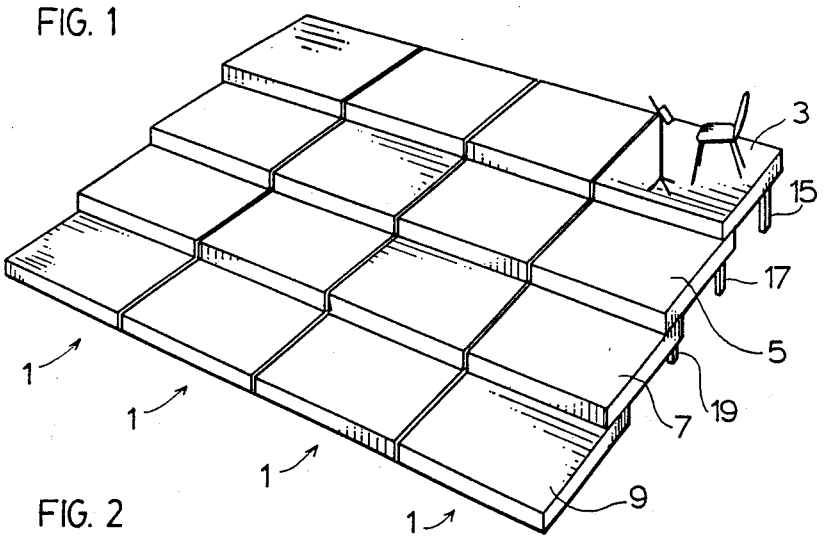
FIG. 1 is a perspective view looking down on a multi-tiered portable stage according to a preferred embodiment of the present invention.
Figure 4:
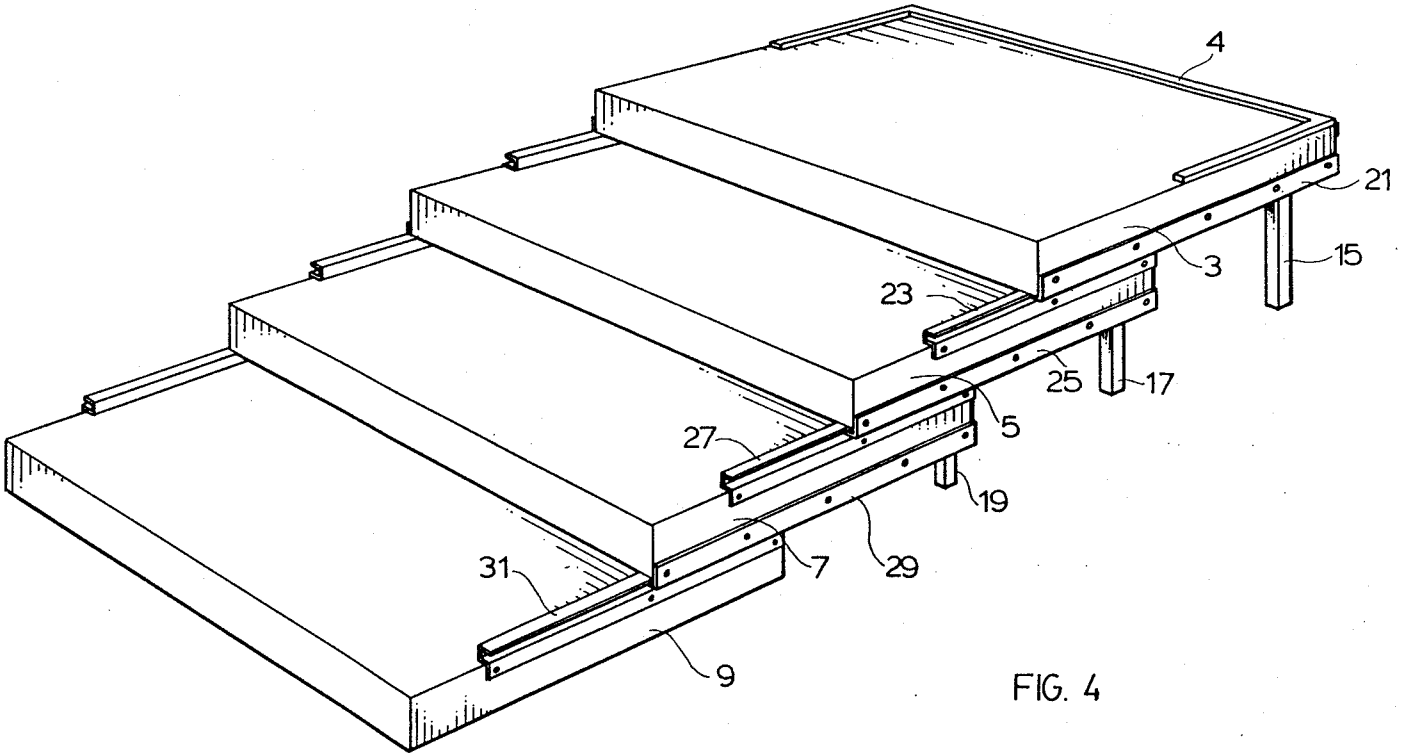
FIG. 4 is a perspective view showing the stage in an extended position and in particular the guide track system for the stage.
Figure 5:
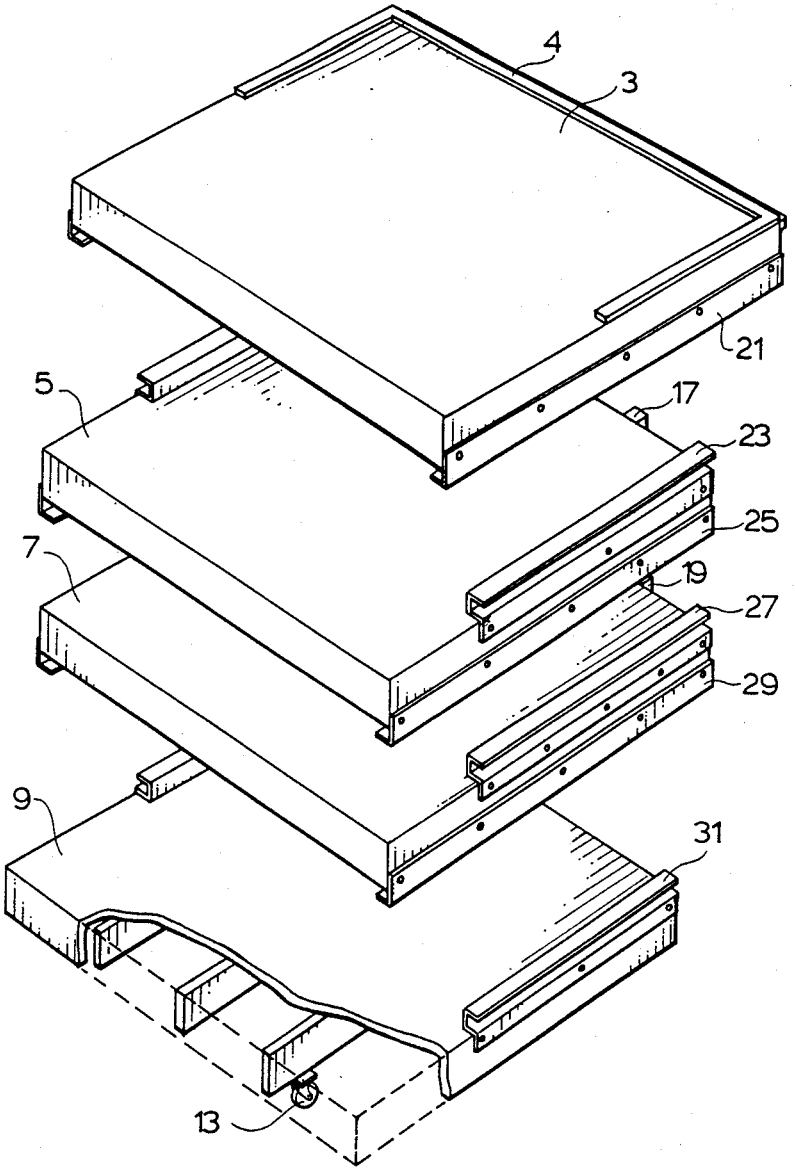
FIG. 5 is an exploded perspective view of the individual stage sections from the stage of FIG. 4.

FIG. 1 shows en entire stage assembly formed by a plurality of multi-tiered stages generally indicated at 1 located side by side with one another. Each of these stages is formed from a plurality of stage sections 3, 5, 7 and 9. These stage sections are telescopically interconnected with one another by a track system as best shown in FIG. 4. Here it will be seen that the uppermost or top stage section 3 is provided with a bottom runner or rail 21 fitted into channel member 23 secured atop stage section 5. Stage section 5 is in turn provided with a bottom runner or rail 25 fitted within channel 27 secured atop stage section 7 which is in turn provided with a bottom runner or rail 25 fitted within channel section 31 of the bottom stage section 9. Note that the channel sections 23, 27 and 31 terminate well short of the front of the individual stage sections leaving freedom to move over each stage section without the fear of tripping or the like.

Figure 2:
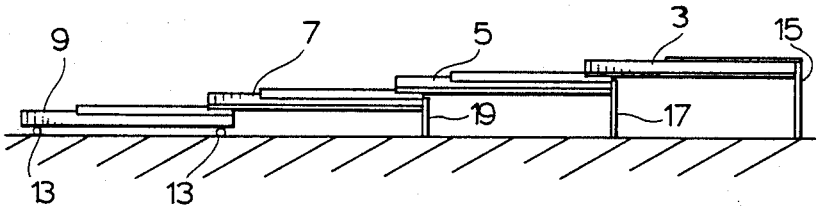
FIG. 2 is a side view of the stage of FIG. 1
Figure 3:
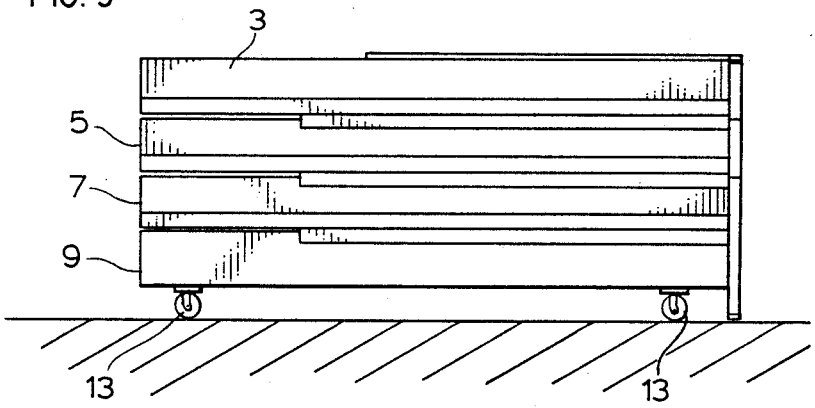
FIG. 3 ia a side view of the stage in a storage position.

The bottom stage section 9 rides on multi-directional, castors 13 and when in the extended position provides support for the front end of stage section 7. Stage section 7 is supported to the rear by upright legs 9 and in turn provides support for the forward end of stage section 5. Stage section 5 includes rearward legs 17 supporting the front end of upper stage section 3 which includes its own rearward supporting legs 15. These legs are provided on the back or rear surfaces of the individual stage sections at right angles to the direction in which the sections slide from a collapsed position as shown in FIG. 3 of the drawings to an extended position as shown in FIG. 2 of the drawings. The runner and channel combinations provided to the bottom of each of the stage sections are preferably made from a material such as TEFLON* or the like which has both a long life and a low coefficient of friction for an easy sliding action between the stage sections.

Figure 6:
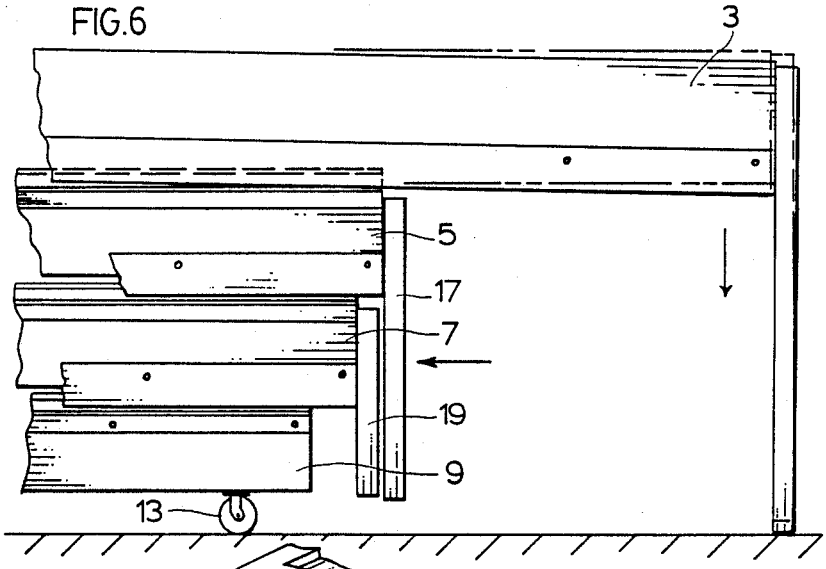
FIG. 6 is a side view of the rear end of the stage of FIG. 1 as it is being collapsed.

FIG. 6 shows the stage as the sections are being pulled out to the extended position. Here it will be seen that the individual sections through the track system as provided have a slight camming effect on one another, whereby, when they are all in the collapsed position, the bottom section 9 riding on its casters 13 lifts the legs of all of the other sections above it slightly off the ground. This feature allows the use of the stationary legs 15, 17 and 19 rather than requiring the use of less supportive rollers oz the like at each of the sections.

Also provided at the rear surface of the structure are a plurality of catches between the individual stage sections as indicated at 6, 8 and 10 respectively. These catches provide stops for determining maximum extension between the stage sections to be described later in detail.

More specifically as will be seen in FIG. 6, when the stage is collapsed each of the stationary legs 15, 17 and 19 is actually lifted off of the ground with the entire stage supported by the casters on the lowest stage section 9. As the lowest stage section is pulled outwardly, with the uppermost section 3 being held against movement, sections 5 and 7 are carried with the lower section 9 leaving the upper section 3 unsupported from beneath. This upper section under its own weight tips rearwardly causing legs 15 to drop from the dotted to the solid line position shown in FIG. 6 and supporting the rear end of the stage, while the forward end is still supported by the casters on the lower stage section. In this position, stage sections 5 and 7 continue to ride with stage section 9 because their rear supporting legs 17 and 19 respectively are still off of the ground as seen in FIG. 6. However, catch 6 mounted on section 5 runs against the forward end of the now stationary section 3, and stops the forward travel of section 5. Section 7 still continues to ride outwardly with section 9 and section 5 then tips rearwardly with its rear legs 17 dropping down to a ground supported position. Section 7 will continue to ride outwardly with section 9 until catch 8 engages the front wall of section 5 preventing any further outward movement of section 7. Section 9 continues to be pulled outwardly with section 7 now being unsupported from beneath and tipping rearwardly causing legs 19 to drop down to a ground supported position. Section 9 will continue to move forwardly until catch 10 mounted on the lower section engages the front wall of the now stationary section 7.

When it is time to put the stage back into its collapsed position the lower section 9 is simply forced beneath section 7 which is held against movement by its supporting legs allowing a telescopic action between these two sections. Similarly, both sections 9 and 7 are pushed inwardly beneath section 5 which is then pushed inwardly beneath section 3 until the entire structure, except for the lowest section, is lifted off the ground.

A pull bar may be provided to assist in pulling the stage sections out to their extended positions. The pull bar is additionally useful in pulling the sections back into their collapsed positions.

When the stage is in its extended position, each of the three sets of legs extending down from stage sections 3, 5 and 7 acts as a brake for stabilizing the unit. In addition, the lowermost stage section 9 may be provided with brakes for the casters thereby substantially eliminating any and all movement of the arrangement when in the extended position.

Figure 7:
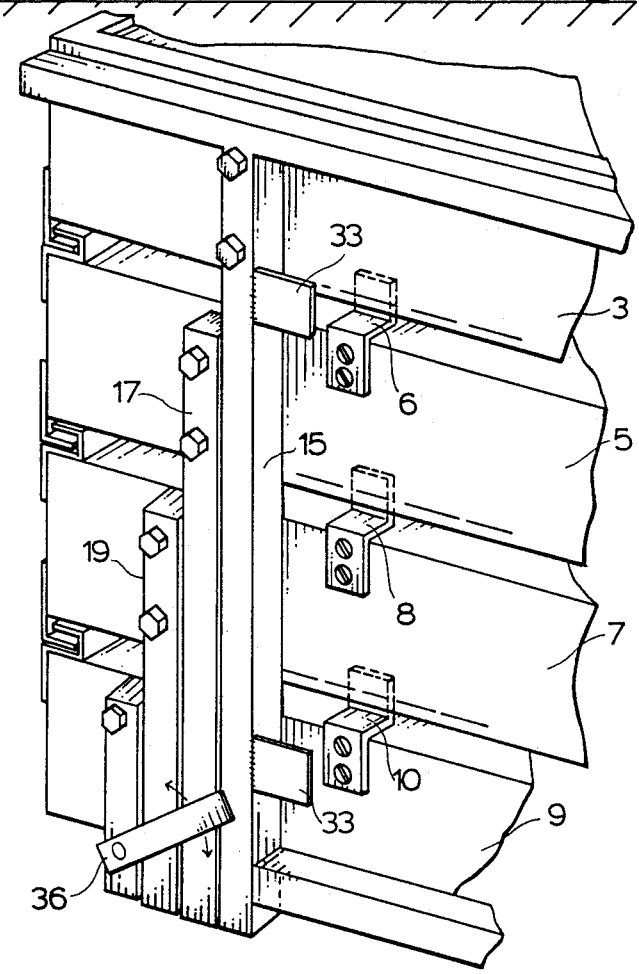
FIG. 7 is an enlarged perspective view of the back surface of the stage of FIG. 6.

When all of the stage sections are completely collapsed as shown in FIG. 7, the supporting legs 15, 17 and 19 all line up with one another along the back surface of the stage. The lowermost stage section 9 is provided with a pivotal lever 36 which swings behind all of these aligned supporting legs to prevent inadvertent extension of the stage sections. This is particularly useful during the tipping of the stage onto the dolly as described below.

Figure 8:
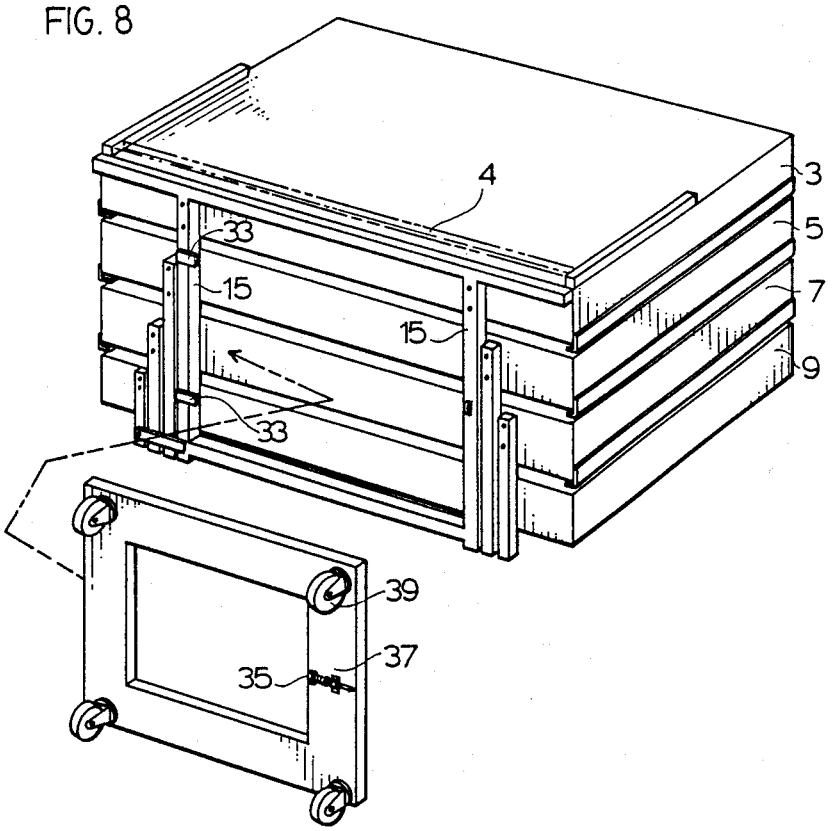
FIG. 8 is a further perspective view from the back of the stage when in a collapsed position and ready to receive e rolling dolly.
Figure 9:
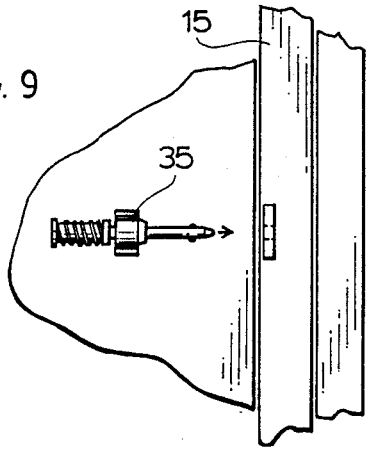
FIG. 9 is an enlarged view showing the locking mechanism for looking the support tray of FIG. 8 to the back of the stage.

As seen in FIGS. 7 and 8 legs 15 form the sides of a rectangular frame at the back of the stage. This set up is designed to receive a dolly 37 as shown in FIG. 8 of the drawings which has its own multi-directional wheels or casters 39. One end of the dolly is first fitted into brackets 33 provided on leg 15 to one side of this frame. The other end of the dolly carrying its own spring loaded pin is then fitted and locked by the pin to the other side of the frame as seen in FIG. 9.

Figure 10:
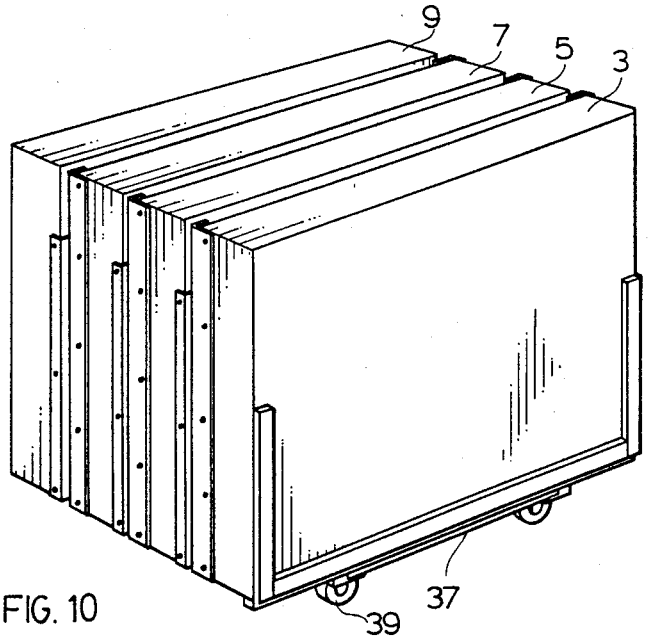
FIG. 10 is a further perspective view of the stage of FIG. 1 when in an upright storage position.

With the dolly locked to the back of the stage as described above, the entire structure is then tipable from the FIG. 8 flat to the FIG. 10 upright storage position. The entire weight of the structure is now supported on the dolly allowing it to easily be rolled to any desired storage location. Furthermore, in its upright storage position, the structure occupies substantially less floor space than in the FIG. 8 flat position and has a much smaller width because of its upright positioning allowing it to be moved through narrower door openings and the like, which would not otherwise be possible in the down flat position.

It will now be seen from the above how the portable stage of the present invention, including multi-tiered stage sections is extremely useful for concerts and the like where members of an instrumental group located to the back of the stage are not hidden by the rest of the group in front of them. Furthermore, the sound created by the instruments at the back of the group is not blocked and will therefore carry out to the audience.

As well shown in FIG. 1 of the drawings, a number of stages may be set up in side to side fashion for a very large group of performers. This set up allows movement from stage to stage and as noted above, the tracks on the individual stage sections extend well short of the front of each section providing a clear path from one stage to the next.

In a different set up the stages may be arranged back to back with one another. For this reason the stage is provided with a removable chair rail 4. By removing the chair rail, there is a clear or continuous stage area between back to back stages allowing movement without fear of tripping. When the chair rail is in position, as shown in the drawings, it provides a safety stop to prevent the musicians chairs from sliding backwards off the top stage section.

The drawings show the use of four sections in each stage, however it is to be appreciated that a different number of stage sections can be provided in an individual stage while still maintaining the portability of the unit. Furthermore, none of the stage sections need to be fully extended, where for example in a standing choir it is more desireable to have only a partial extension to have the choir members standing closer to one another.

When it is desired to store each of the stages, they are easily telescoped to the collapsed position and from there further tipable to the upright storage position minimizing space requirements for the stored collapsed stages. In addition, the stage when stored upright can easily be moved from place to place to set up in different desired locations.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A portable stage comprising a plurality of individual stage sections at different heights and telescopically interconnected by a track system for sliding from a collapsed to an extended position, said stage having a back frame at right angles to the direction in which said sections slide and said back frame comprising a guide for both collapsed storage of said individual stage sections and for removably receiving a dolly onto which said stage is tippable when collapsed for upright storage of said stage.

2. A stage as claimed in claim, 1 including a bottom stage section supported on rollers and an upper stage section above said bottom stage section, said upper stage section being secured directly to said frame and said bottom stage section being movable away from said frame when in the extended position and onto said frame when in the collapsed position, said frame having rear legs which are in a ground contacting position when said stage is in said extended position and which are elevated from said ground contacting position when said stage is in said collapsed position.

3. A stage as claimed in claim 1, including releasable locking means at said back surface of said stage to lock against premature release of said stage and preventing same from moving to said extended position.

4. A portable stage comprising a plurality of individual stage sections at different heights and telescopically interconnected by a track system for sliding from a collapsed to an extended position, means for locking said stage in said collapsed position, said stage having a back surface at right angles to the direction in which said sections slide, said back surface being provided with an open frame, said open frame comprising a guide onto which said stage sections collapse and being fitted with a dolly removably from said frame and said stage being tippable onto said dolly for storage of said stage in an upright position and movability of said stage when in said upright position.

5. A portable stage, including a bottom stage section and a plurality of upper stage sections including a top stage section all interconnected by a track system for moving from an extended to a collapsed position, said top stage section being secured to a rear frame for said stage, said bottom stage section being supported on roller means and said upper stage sections having rearward downwardly extending supports, the downwardly extending support on said top stage section forming part of said frame, said rearward downwardly extending supports on said upper stage sections all being elevated from a ground contacting position when said stage is in said collapsed position with each of said upper stage sections being rearwardly tippable by an imbalancing of same as said stage is moved to the extended position such that said rearward supports drop down into a ground engaging position for supporting said stage when in said extended position, said frame providing a guide for both collapsing of said stage sections and a dolly removably secured in said frame and onto which said stage is tippable for upright storage and movement of same when in said collapsed position.

* * * * *